US007451974B2

(12) United States Patent
Niizeki

(10) Patent No.: US 7,451,974 B2
(45) Date of Patent: Nov. 18, 2008

(54) RECORDING MEDIUM CONVEYANCE DEVICE AND INK JET RECORDING APPARATUS EQUIPPED THEREWITH

(75) Inventor: Yasushi Niizeki, Hachioji (JP)

(73) Assignee: Konica Minolta Holdings Inc., Tokyo (JP)

( * ) Notice: Subject to any disclaimer, the term of this patent is extended or adjusted under 35 U.S.C. 154(b) by 465 days.

(21) Appl. No.: 10/863,760

(22) Filed: Jun. 7, 2004

(65) Prior Publication Data

US 2004/0251618 A1 Dec. 16, 2004

(30) Foreign Application Priority Data

Jun. 13, 2003 (JP) ..... 2003-169641

(51) Int. Cl.
*B65H 3/06* (2006.01)

(52) U.S. Cl. ..... 271/109; 271/272

(58) Field of Classification Search ..... 271/109, 271/272–274

See application file for complete search history.

(56) References Cited

U.S. PATENT DOCUMENTS

| | | | | | |
|---|---|---|---|---|---|
| 4,558,373 | A * | 12/1985 | Plasencia et al. | ..... | 358/484 |
| 5,520,383 | A * | 5/1996 | Amagai et al. | ..... | 271/265.01 |
| 5,669,605 | A * | 9/1997 | Sawa et al. | ..... | 271/314 |
| 5,735,388 | A * | 4/1998 | Brouwer | ..... | 198/699.1 |
| 5,797,827 | A * | 8/1998 | Sondergeld | ..... | 492/37 |
| 5,846,007 | A * | 12/1998 | Nakayama et al. | ..... | 400/624 |
| 5,897,259 | A * | 4/1999 | Ahn | ..... | 400/629 |
| 6,540,218 | B2 * | 4/2003 | Tsukada et al. | ..... | 271/18.3 |
| 6,890,114 | B2 * | 5/2005 | Kawaguchi | ..... | 400/641 |
| 2001/0041652 | A1 * | 11/2001 | Tsukada et al. | ..... | 492/30 |
| 2003/0230847 | A1 * | 12/2003 | Shikahama et al. | ..... | 271/264 |
| 2004/0026844 | A1 * | 2/2004 | Toriumi et al. | ..... | 271/109 |
| 2004/0251619 | A1 * | 12/2004 | Goto | ..... | 271/274 |
| 2006/0071421 | A1 * | 4/2006 | Itoh | ..... | 271/272 |

FOREIGN PATENT DOCUMENTS

| | | | |
|---|---|---|---|
| DE | 3545304 | A1 * | 7/1987 |
| JP | 08310703 | A * | 11/1996 |
| JP | 10109777 | A * | 4/1998 |
| JP | 10236683 | A * | 9/1998 |
| JP | 11-240654 | | 9/1999 |
| JP | 2000159377 | A * | 6/2000 |
| JP | 2000159378 | A * | 6/2000 |
| JP | 2000159379 | A * | 6/2000 |

* cited by examiner

*Primary Examiner*—Patrick Mackey
*Assistant Examiner*—Gerald W McClain
(74) *Attorney, Agent, or Firm*—Frishauf, Holtz, Goodman & Chick, P.C.

(57) ABSTRACT

In a recording medium conveyance device for conveying a recording medium gripped between a conveyance roller which is driven by a driving device and has a number of protrusions provided on its surface and a pressing roller arranged opposite to the conveyance roller, there is further provided with a pressing force varying device for varying the pressing force of the pressing roller acting on the recording medium, wherein the recording medium conveyance device varies the conveyance amount of the recording medium by varying the penetration amount of the protrusions into the recording medium through varying the pressing force of the pressing roller by the pressing force varying device.

7 Claims, 4 Drawing Sheets

FIG. 3 ( a )
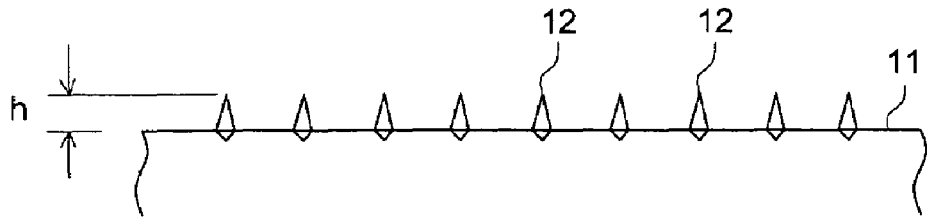
FIG. 3 ( b )
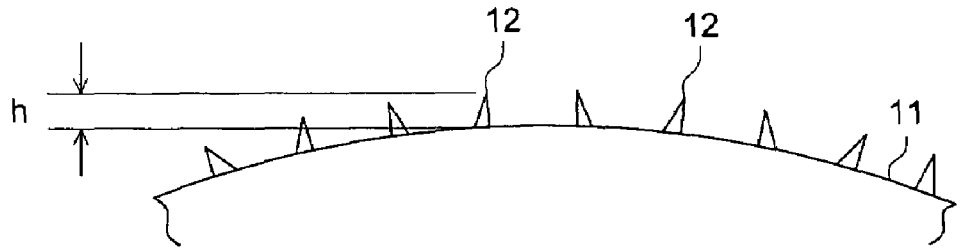
FIG. 4
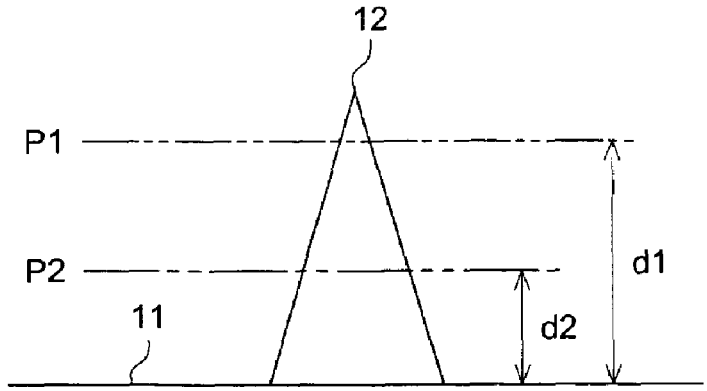

RECORDING MEDIUM CONVEYANCE DEVICE AND INK JET RECORDING APPARATUS EQUIPPED THEREWITH

BACKGROUND OF THE INVENTION

This invention relates to a recording medium conveyance device for conveying a recording medium to have an image recorded thereon and an ink jet recording apparatus using this.

In a recording apparatus of an ink jet method in which image recording is carried out by jetting of ink drops to a recording medium, in order to record a high-quality image without generating a deviation of an image and a blur of the colors, it is important to maintain the accuracy of conveyance of a recording medium at a high level.

Up to this time, as regards such a technology for practicing the conveyance of a recording medium with a high accuracy, as described in the publication of the Japanese unexamined patent application H11-240654, it has been known, a conveyance device for conveying a recording medium by means of a conveyance roller (a capstan roller) and a pressing roller (a pinch roller) wherein, by protrusions having a convex shape of a height of 60 ± 40 μm and a diameter of 0.5±0.2 mm being arranged on the surface of the conveyance roller over a half or larger part of the surface area, the force to hold a recording medium by the conveyance roller and the pressing roller is strengthened, and the accuracy of conveyance is secured.

In a conventional recording medium conveyance device, there has been a problem that the quality of an image to be recorded is degraded if the conveyance length (that is, the length of one step of an intermittent feed) of a recording medium varies owing to a change of the thickness, the kind of the recording medium; therefore, it is necessary to adjust minutely the conveyance length by the conveyance roller. Usually, a stepping motor is used as a driving motor of the conveyance roller, and it is put into practice to adjust the conveyance length by changing the drive pulse. However, it is impossible to adjust the conveyance length by an amount smaller than the resolving power of the driving motor, and it has not been possible, by minutely varying the conveyance length of the recording medium, to practice an adjustment of the conveyance length to cope with the minute change of the thickness, the kind of a recording medium.

Further, in many cases, an image recording for a recording medium is carried out in the following way. That is, two sets of a conveyance roller and a pressing roller are provided with a recording means for recording an image put between the two sets, both the conveyance rollers are driven by one and the same driving motor, and a recording medium is stretched between the two sets of rollers. However, there is a problem that, even if both the conveyance rollers are driven by one and the same driving motor, owing to a variety of factors such as the deviation of the diameter of the conveyance rollers and the transmission loss of the driving force, a minute difference is produced in the conveyance length between the conveyance rollers, which produces a slack of the recording medium, or causes the recording medium to be pulled excessively by one of the conveyance rollers, and this influences the quality of an image to be recorded. Because it is impossible to adjust the conveyance length by an amount less than the resolving power of the driving motor, it has been impossible to adjust the conveyance length of a recording medium through minutely varying the conveyance length, to get rid of a slack or an excessive stretch of a recording medium.

Further, concerning the manufacturing of conveyance rollers, there has also been a problem that, in cases where a roller has a diameter variation in its axial direction, the conveyance length of a recording medium becomes different depending on the position in the axial direction, which causes a conveyance skew or a slack of a recording medium to be produced.

SUMMARY OF THE INVENTION

Thus, it is the first object of this invention to provide a recording medium conveyance device which is capable of varying the virtual feed diameter of a conveyance roller to minutely adjust the conveyance length of a recording medium, by varying the penetration amount of the protrusions formed on the surface of its conveyance roller into the recording medium, and an ink jet recording apparatus equipped therewith.

Further, it is the second object of this invention to provide a recording medium conveyance device which is capable of adjusting minutely a difference in the conveyance length of a recording medium between two conveyance rollers for conveying a recording medium and never causes a slack or an excessive stretch of the recording medium to be produced, and an ink jet recording apparatus equipped therewith.

Furthermore, it is the third object of this invention to provide a recording medium conveyance device which never generates a conveyance skew or a slack of a recording medium caused by the variation of the conveyance length in the axial direction of the conveyance roller, and an ink jet recording apparatus equipped therewith.

Other objects of this invention will be apparent by the following statement of this description.

The above-mentioned objects can be accomplished by any one of the structures (1) to (9) described below.

(1) A recording medium conveyance device for conveying a recording medium gripped between a conveyance roller which is driven by a driving means and has a number of protrusions provided on its surface and a pressing roller arranged opposite to said conveyance roller, characterized by being equipped with a pressing force varying means for varying the pressing force of said pressing roller acting on said recording medium, and said recording medium conveyance device varying the conveyance length of said recording medium by varying the penetration amount of said protrusions into said recording medium through varying the pressing force of said pressing roller by said pressing force varying means.

(2) A recording medium conveyance device as set force in the structure (1), characterized by controlling the conveyance length of a recording medium by determining the penetration amount H for a thickness t of said recording medium to fall within a range defined by the inequality $0.1t<H<0.25t$, by varying the pressing force of the aforesaid pressing roller.

(3) A recording medium conveyance device as set force in the structure (1) or (2), characterized by having a structure such that it is provided with two equal sets of the aforesaid conveyance roller and the aforesaid pressing roller arranged along the conveyance direction of the aforesaid recording medium, and is capable of varying the pressing force of each of the pressing rollers independently.

(4) A recording medium conveyance device as set force in the structure (3), characterized by the pressing force of the pressing roller located at the upstream side in the conveyance direction is made to be larger than the pressing force of the pressing roller located at the downstream side in the conveyance direction.

(5) A recording medium conveyance device for conveying a recording medium gripped between a conveyance roller which is driven by a driving means and has a number of protrusions provided on its surface and a pressing roller arranged opposite to said conveyance roller, characterized by said recording medium conveyance device being provided with two equal sets of said conveyance roller and said pressing roller arranged along the conveyance direction of said recording medium, and the protruded height of the protrusions of the surface of the conveyance roller located at the downstream side in the conveyance direction being made to be larger than the protruded height of the protrusions of the conveyance roller located at the upstream side in the conveyance direction.

(6) A recording medium conveyance device for conveying a recording medium gripped between a conveyance roller which is driven by a driving means and has a number of protrusions provided on its surface and a pressing roller arranged opposite to said conveyance roller, characterized by said recording medium conveyance device being provided with two equal sets of said conveyance roller and said pressing roller arranged along the conveyance path of said recording medium, and the number of the protrusions per unit area of the surface of the conveyance roller located at the downstream side in the conveyance direction being made to be larger than the number of the protrusions per unit area of the surface of the conveyance roller located at the upstream side in the conveyance direction.

(7) A recording medium conveyance device as set force in any one of the structures (3) to (6), characterized by both the aforesaid conveyance rollers being driven by one and the same driving means.

(8) A recording medium conveyance device for conveying a recording medium gripped between a conveyance roller which is driven by a driving means and has a number of protrusions provided on its surface and a pressing roller arranged opposite to said conveyance roller, characterized in that said pressing roller is divided into a plurality of portions along its axial direction, a pressing force varying means for varying the pressing force acting on said recording medium is provided for each portion of the pressing roller, and the conveyance length of said recording medium is varied in the axial direction of the conveyance roller, by the penetration amount of said protrusions into said recording medium being varied through the change of the pressing force of each of said divisional portions of the pressing roller caused by said pressing force varying means.

(9) An ink jet recording apparatus characterized by comprising a recording means for recording an image on a recording medium by jetting ink drops thereto, and a recording medium conveyance device as set forth in any one of the structures (1) to (8).

BRIEF DESCRIPTION OF THE DRAWINGS

FIG. 3(*a*) and FIG. 3(*b*) are drawings each showing protrusions; FIG. 3(*a*) shows the surface of a conveyance roller as viewed from the direction perpendicular to its axis, and FIG. 3(*b*) shows the surface of a conveyance roller as viewed from its axial direction;

FIG. 4 is a conceptual drawing showing the penetration of a protrusion into a recording medium;

DETAILED DESCRIPTION OF THE PREFERRED EMBODIMENT

In the following, the embodiment of this invention will be explained with reference to the drawings.

Figure 1:
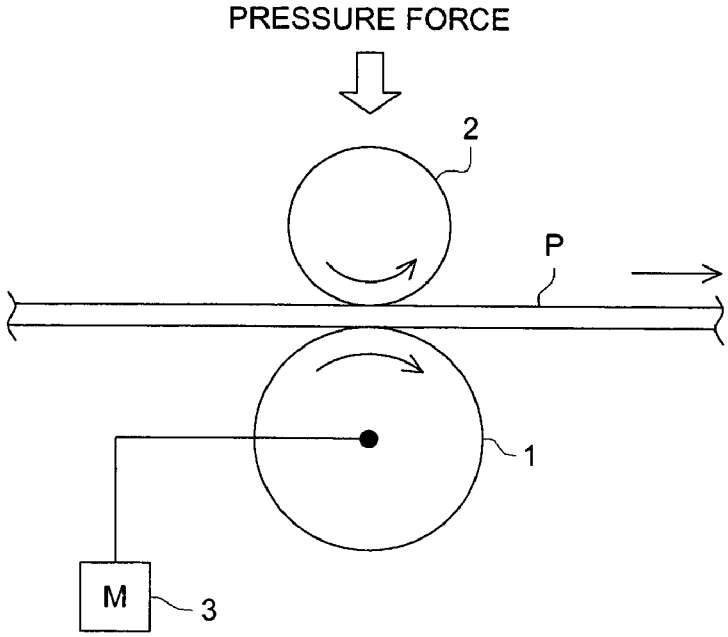
FIG. 1 is a drawing showing an outline of the structure of a recording medium conveyance device as an example of the embodiment of this invention.

FIG. 1 is a drawing showing an outline of the structure of a recording medium conveyance device of this invention. A recording medium conveyance device has a conveyance roller 1 and a pressing roller 2 which is made up of a rubber roller, is located opposite to this conveyance roller 1, and is pressed to the surface of the conveyance roller 1 by a predetermined pressing force. Said recording medium conveyance device grips a recording medium P between these conveyance roller 1 and pressing roller 2, and by the clockwise rotation of the conveyance roller 1 as shown in the drawing caused by the driving of a driving motor 3 such as a stepping motor which is a driving means, it conveys the recording medium P to the right direction as shown in the drawing, while it drives the pressing roller to rotate.

In addition, in this invention, a recording medium P includes not only a paper sheet, but also a recording medium such as an artificial resin sheet like an OHP sheet or a fabric sheet which is subject to penetration by protrusions 12 of the conveyance roller 1 to be described later and is conveyed by the conveyance roller 1, assisted by the penetration of said protrusions 12.

Figure 2:
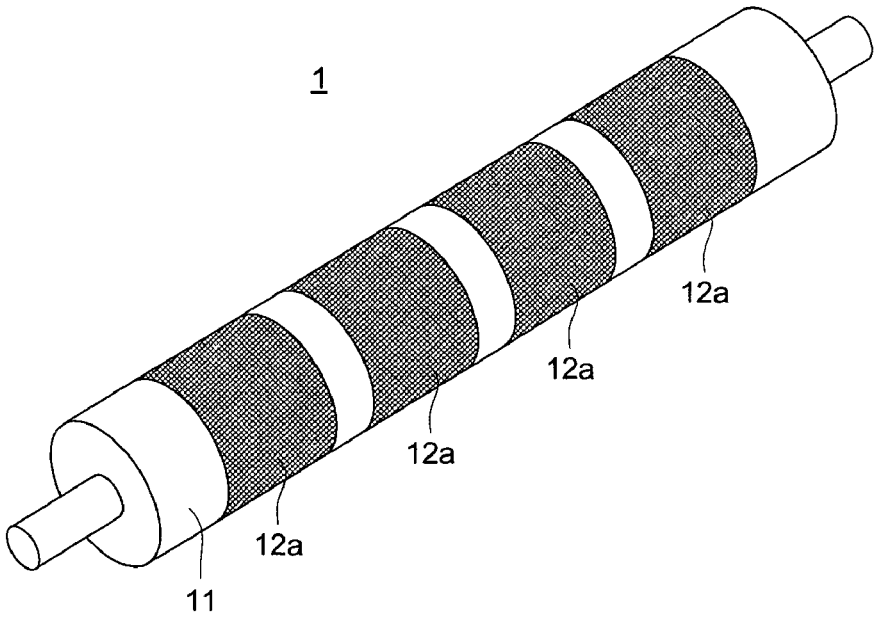
FIG. 2 is a perspective view of a conveyance roller.

The conveyance roller 1 is made up of a metallic roller, and a number of protrusions 12 are formed on its surface. FIG. 2 is a perspective view of the conveyance roller 1, FIG. 3(*a*) and FIG. 3(*b*) are drawings each showing the protrusions 12, FIG. 3(*a*) is a drawing showing the surface 11 of the conveyance roller 1 as viewed from the direction perpendicular to its axis, and FIG. 3(*b*) is a drawing showing the surface of the conveyance roller 1 as viewed from its axial direction. The sign 12*a* in FIG. 2 represents a protrusion formation area, and in this drawing, four protrusion formation areas 12*a* are formed with intervals put in between along the axial direction of the conveyance roller 1; however, as regards the number of the protrusion formation areas, it is not limited to a particular one. The protrusion formation areas 12*a* spread over the whole circumference of the conveyance roller 1.

The protrusions 12 formed in each of the protrusion formation areas 12*a*, as shown in FIG. 3(*a*) and FIG. 3(*b*), are formed as protruded from the surface 11 of the conveyance roller 1.

These protrusions can be formed by a manufacturing method similar to that of the protrusions of a file or a grater. That is, a metal die having a minute sharp concave and convex portions is strongly pressed on the surface 11 of the conveyance roller 1, and the metallic minute portions of the surface 11 are caused to rise up as if they were scooped out to become protruded out of the surface 11, thereby the protrusions 12 can be produced.

It is desirable if two kinds of protrusion having different directions of rising up with respect to the circumferential direction of the conveyance roller 1 are made to be mixedly present on the conveyance roller 1, because it is possible to obtain a conveyance force of the conveyance roller 1 based on a strong gripping force for a recording medium P by the protrusions 12 in any one of both the forward rotation and the reverse rotation.

As regards the form of the arrangement of the protrusions 12 in each of the protrusion formation area 12*a*, various forms of arrangement such as an arrangement of them in a grid pattern on the surface 11 of the conveyance roller 1, an arrangement of them along the axial direction in a line and in a zigzag way in the circumferential direction, and an arrangement of them in a zigzag way in the axial direction and along a line in the circumferential direction can be used, and in this invention, it is not limited to a particular one.

As regards the shape of the protrusions, it is not limited to a particular one; however, it is desirable, as shown in the drawing, if it is made to gradually taper from the base portion at the side of the surface 11 of the conveyance roller 1 towards the end, because the protrusions become easy to stick the rear surface (the surface in contact with the conveyance roller 1) of the recording medium P to penetrate into it.

In this recording medium conveyance device, when a recording medium P is gripped between the above-mentioned conveyance roller 1 and pressing roller 2 with its recording surface made to face the pressing roller 2, and the recording medium P is pressed to the surface of the conveyance roller 1 by the pressing roller 2, the protrusions 12 formed on the surface of the conveyance roller 1 stick the rear surface of the recording medium P to get penetration. By varying the penetration amount at this time, it is possible to vary the virtual feed diameter of the conveyance roller 1.

For example, as shown conceptually in FIG. 4, as regards the protrusions formed as protruded out of the surface 11 of the conveyance roller 1, if a recording medium P1 having been subjected to the penetration caused by the pressing of the pressing roller 2 with a first pressing force is compared to a recording medium P2 having been subjected to the penetration caused by the pressing of the pressing roller 1 with a second pressing force which is larger than the above-mentioned first pressing force, because the distances from the surface 11 d1 and d2 are different, in the case where the conveyance roller 1 is rotated at the same speed for both the recording media, the conveyance length (the length of feeding a recording medium in one main scan) of the recording medium P1 becomes larger than that of the recording medium P2. The difference of the conveyance length for a recording medium P caused by this difference in the depth of penetration of the protrusions 12 results in an extremely minute difference of the conveyance length caused by the extremely minute protrusions 12. Therefore, by varying the penetration amount of the protrusions 12 into a recording medium P, it is unnecessary to change the number of drive pulses of the driving motor 3, and it is possible to make an extremely minute adjustment of the conveyance length less than the resolving power of the driving motor 3.

Of course, the penetration amount H of each of the protrusions 12 into a recording medium P becomes different depending on the pressing force. However, as regards the order of its value that exhibits a high accuracy of conveyance with no slack and looseness for obtaining a high-quality image recording, and does not give any substantial damage to a recording medium p, a value not greater than a half of the thickness t of the recording medium P to be conveyed (not greater than 0.5 t) is desirable. It is more desirable to make it satisfy the following inequality: $0.1t<H<0.25t$.

In the following, it is shown a table representing the relation of the conveyance length for three different pressing forces measured with respect to also three different values of the amount (height) of protrusions on the roller.

(Major Conditions of the Recording Device)

Conveyance roller (protrusion roller) material: SUS

Thickness of recording medium: 0.25 mm when a photographic paper is used

Width of recording medium: 102 mm

Three protrusion rollers having their respective protrusions of the amounts 40 μm, 60 μm, and 80 μm are prepared, and the values of the conveyance length (mm) for the three values of the pressing force varied as 1.64 N, 3.27 N, and 6.54 N are shown below.

TABLE 1

| | Amount of roller protrusion (μm) | | |
|---|---|---|---|
| Pressing force (N) | 40 | 60 | 80 |
| 1.64 | 3.971 mm | 3.982 mm | 4.003 mm |
| 3.27 | 3.969 mm | 3.980 mm | 4.001 mm |
| 6.54 | 3.966 mm | 3.979 mm | 3.995 mm |

In addition, any one of these pressing forces made it possible to convey a photographic paper as a recording medium at a high accuracy, and the penetration amount at that time generally came within the range satisfying the inequality $0.1t<H<0.25t$.

This implies that an extremely minute adjustment of conveyance length not greater than the resolving power of the driving motor 3 can be made by the control of the penetration amount through the varying of the pressing force as described in the above, even though the conveyance length is minutely varied by the change of the thickness or the kind of the recording medium.

Figure 5:
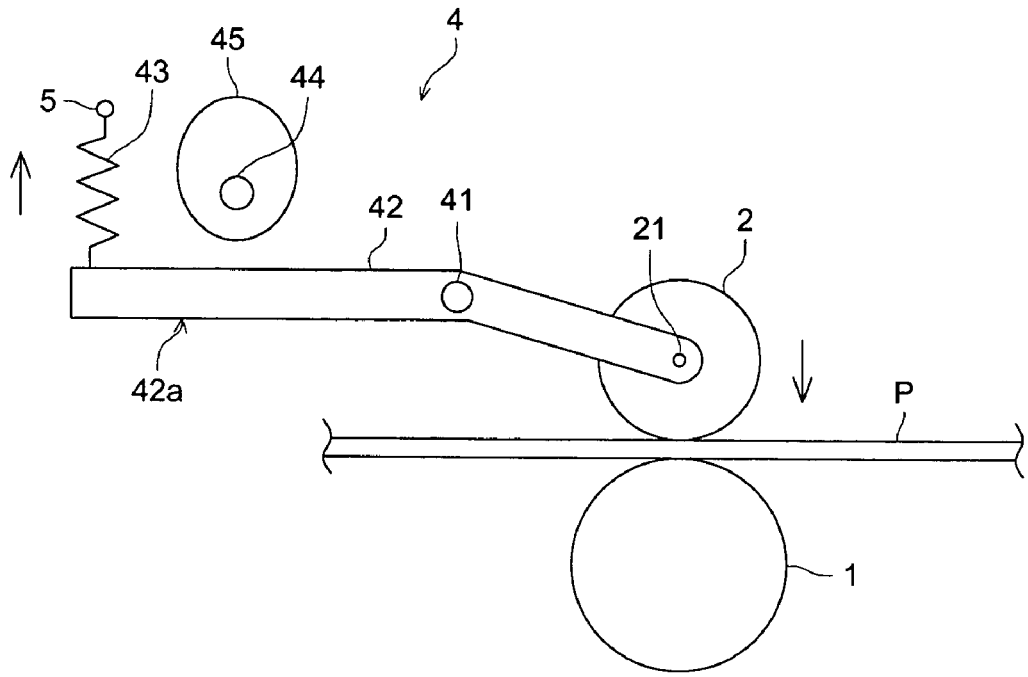
FIG. 5 is a drawing showing an outline of the structure of an example of a pressing force varying means.
Figure 6:
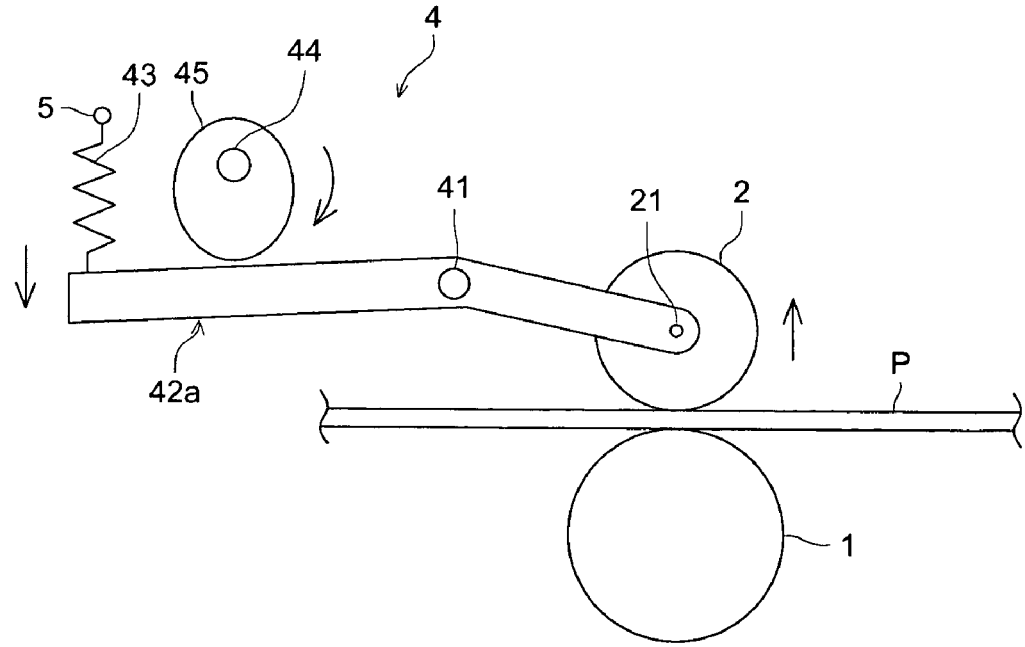
FIG. 6 is a drawing showing an outline of the structure of an example of a pressing force varying means.

For the purpose of such an adjustment of the penetration amount of the protrusions 12 into a recording medium P, for the pressing roller 2, a pressing force varying means for varying the pressing force acting on the recording medium P is provided. As regards the pressing force varying means, any one may be employed so long as it can vary the pressing force of the pressing roller minutely. An example of it is shown in FIG. 5 and FIG. 6. FIG. 5 and FIG. 6 are drawings each showing the outline of the structure of the pressing force varying means 4.

The pressing roller 2 is supported by its rotary shaft 21 at one end of a support member 42 capable of oscillation around a support shaft 41 which is parallel to the rotary shaft 21 of the pressing roller 2, and at the other end of the support member 42 reverse to the pressing roller 2 with respect to the support shaft 41, one end of an urging spring 43 is fixed. In this case, the urging spring 43 is made up of a tension spring, and the other end of it is fixed at the fixing point 5. Accordingly, by the urging force of this urging spring 43, the pressing roller 2 is urged to the direction of pressing against the conveyance roller 1. In this mode, the maximum pressing force of the pressing roller 2 is determined by the urging force of the urging spring 43.

Above the support member 42, an eccentric cam 45 is arranged rotatably around a shaft 44, and is to be rotated by a driving motor (not shown in the drawing). In the state shown in FIG. 5, the cam surface of the eccentric cam 45 is not in contact with the support member 42, which presses a recording medium P to the conveyance roller 1 by the urging force of the urging spring 43. In this state, the pressing roller 2 presses the recording medium P to the conveyance roller 1 with the maximum pressing force of the urging spring 43, and the protrusions 12 of the conveyance roller 1 penetrates most deeply through the rear surface of the recording medium P.

When the eccentric cam 45 is rotated from this state around the shaft 44, the cam surface of the eccentric cam 45 is brought into contact with the end-of-action point 42*a* located at a position on the support member 42 close to the urging spring 43 with respect to the support shaft 41, and with the rotation of the eccentric cam 45, against the urging force of the urging spring 43, makes the part of the support member 42 including the end-of-action poring 42*a* oscillate downward in the drawing around the support shaft 41. By this motion, the pressing roller 2 is moved to the direction departing from the conveyance roller 1, and the pressing force acting on the recording medium P is weakened.

FIG. 6 shows the state in which the pressing force acting on the recording medium P is weakened to the utmost by the eccentric cam pressing the end-of-action point 42*a* of the support member 42 up to the lowest position, and the protrusions 12 of the conveyance roller 1 penetrates through the rear surface of the recording medium most shallowly. By varying the rotational angle of the eccentric cam 45, it is possible to adjust the pressing force of the pressing roller 2 between the state shown in FIG. 5 and the state shown in FIG. 6.

In addition, as regards how to operate this pressing force varying means, various kinds of embodiment can be considered, and for example, following examples of the embodiment can be employed.

(a) A mode in which a user of the apparatus (for example, an ink jet recording apparatus) selects the material, kind, thickness, etc. of the recording medium by the operation panel of its display section, and makes the pressing force varying means operate so as to vary the pressing force to become suitable to the kind, or the thickness selected.

(b) A mode in which the kind or the thickness of the recording medium to be conveyed is automatically judged from its electric resistance value, and the above-mentioned pressing force varying means is made to operate so as to vary the pressing force to become suitable to the kind or the thickness judged.

(c) A mode in which a setting is made beforehand in the manufacturing stage of the apparatus so as to actualize the pressing force suitable to the kind or the thickness of the recording medium to be conveyed.

Figure 7:
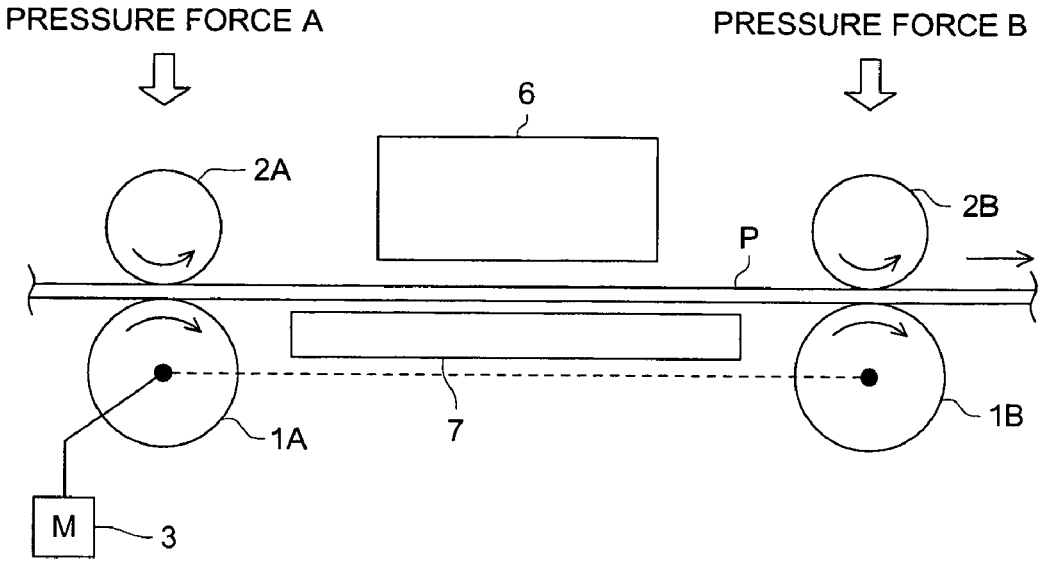
FIG. 7 is a drawing showing an outline of the structure of a recording medium conveyance device as another example of the embodiment of this invention.

FIG. 7 is a drawing showing the outline of the structure a recording medium conveyance device as another example of the embodiment of this invention. In this drawing, the outline structure of a recording medium conveyance device installed in an ink jet recording apparatus is shown.

In the drawing, 6 denotes a recording head which is a recording means for practicing image recording by jetting ink drops from a number of nozzles arranged opposite to a recording medium P, and 7 denotes a platen arranged opposite to the recording head 6 with respect to the recording medium P positioned between them.

The recording head 6 is installed on a carriage (not shown in the drawing), and by jetting ink drops in the main scanning process which is carried out by the carriage being driven by a driving motor (not shown in the drawing) in the direction perpendicular to the conveyance direction of the recording medium P, it carries out an image recording of one line on the recording medium P. The recording medium conveyance device is designed in such a manner as to intermittently convey the recording medium by a predetermined amount in the sub-scanning direction (right direction in the drawing) for each main scanning by the recording head 6. Thus, by the main scanning of the recording head 6 and the intermittent conveyance of the recording medium P by the recording medium conveyance device, a desired image is recorded on the recording medium P.

The recording medium conveyance device shown here is equipped with two sets of a conveyance roller and a pressing roller with the recording head placed between them. That is, with the recording head 6 placed in between, at the upstream side in the conveyance direction of the recording medium P (left side in the drawing), the set of a conveyance roller 1A and a pressing roller 2A is arranged, and at the downstream side in the conveyance direction of the recording medium P, the set of a conveyance roller 1B and a pressing roller 2B is arranged.

The conveyance rollers 1A and 1B and the pressing rollers 2A and 2B have the same structure for the two sets, and the conveyance rollers 1A and 1B are designed in such a manner as to be driven at the same speed.

Now, there will be explained the first embodiment of a recording medium conveyance device equipped with two sets of a conveyance roller and a pressing roller with a recording head 6 placed in between.

For each of the pressing rollers 2A and 2B, a pressing force varying means as shown in FIG. 5 and FIG. 6 is provided, and each makes it possible to independently vary the pressing force A and the pressing force B. By making it possible to independently vary the pressing forces A and B of their respective pressing rollers 2A and 2B, it becomes possible to obtain a difference in the penetration amount of the protrusions of each of the conveyance roller 1A and 1B into the recording medium P, which makes the conveyance rollers 1A and 1B have a difference in the virtual diameter, which makes it possible to adjust freely the conveyance length of the two conveyance rollers 1A and 1B.

Accordingly, even if a slack or an excessive stretch is generated in a recording medium P owing to a slight difference being produced in the conveyance length between the two conveyance rollers 1A and 1B, by an independent adjustment of the pressing forces A and B of their respective pressing rollers 2A and 2B, the conveyance length by each of the conveyance rollers 1A and 1B can be adjusted, with both the rollers driven at the same speed by one and the same driving source. Thus, it is possible to get rid of a slack or an excessive stretch of a recording medium P, which makes it possible a stable recording by the recording head 6, thereby it is possible to record a high-quality image.

However, in a case where the pressing forces A and B of their respective pressing rollers 2A and 2B are made to be different from each other as described above, it is desirable to make the pressing forces A and B satisfy the inequality A>B. By doing this, the penetration amount into a recording medium P by the protrusions of the conveyance roller 1B at the downstream side in the conveyance direction becomes relatively smaller than that of the conveyance roller 1A at the upstream side in the conveyance direction, which makes the virtual feed diameter of the conveyance roller 1B at the downstream side in the conveyance direction relatively larger, and the conveyance length of the recording medium P by the roller 1B becomes relatively larger than that by the conveyance roller 1A. Accordingly, although being driven at the same speed by one and the same driving source, the conveyance rollers 1A and 1B make it possible to stretch the recording medium P at a suitable degree between them to cause the smoothness of the recording surface to be maintained.

Next, there will be explained the second example of the embodiment of a recording medium conveyance device equipped with two sets of a conveyance roller and a pressing roller with a recording head 6 placed in between.

This embodiment is such that the protrusion height of the protrusions of the conveyance roller 1B located at the downstream side in the conveyance direction is made larger than the protrusion height of the protrusions of the conveyance roller 1A located at the upstream side in the conveyance direction. In this case, the conveyance speed and the outer diameter (not including the protrusions) are the same for both the conveyance rollers 1A and 1B.

By doing this way, assuming that the pressing forces A and B of their respective pressing rollers 2A and 2B are the same, the virtual feed diameter of the conveyance roller 1B located at the downstream side in the conveyance direction becomes relatively larger, and the conveyance length of a recording medium P by it becomes larger than that by the conveyance roller 1A. Accordingly, although being driven at the same speed by one and the same driving source, the conveyance rollers 1A and 1B make it possible to stretch the recording medium P at a suitable degree between them, which makes it possible to maintain the smoothness of the recording surface.

In addition, concerning the above-mentioned effect to be exhibited, a pressing force varying means is not required particularly for each of the pressing rollers 2A and 2B. However, it is a matter of course to make it possible by providing a pressing force varying means for each of the pressing rollers 2A and 2B in the same way as the first embodiment, to get rid of a problem of a recording medium P having a slack or an excessive stretch caused by the slight difference in the conveyance length produced between the conveyance rollers 1A and 1B.

Next, there will be explained the third example of the embodiment of a recording medium conveyance device equipped with two sets of a conveyance roller and a pressing roller with a recording head 6 placed in between.

This embodiment is such that the number of protrusions per unit area on the surface of the conveyance roller 1B located at the downstream side in the conveyance direction is made larger than the number of protrusions per unit area on the surface of the conveyance roller 1A located at the upstream side in the conveyance direction. In this case, the conveyance speed and the outer diameter (not including the protrusions) are the same for both the conveyance rollers 1A and 1B.

If the number of protrusions per unit area is large, because the number of the contact points of the recording medium with the protrusions becomes large, the protrusions become hard to penetrate into the recording medium P. On the contrary, if the number of protrusions per unit area is small, because the number of the contact points of the recording medium with the protrusions becomes small, the protrusions become easy to penetrate into the recording medium P. Accordingly, by the number of the protrusions per unit area, it is possible to vary the penetration amount into a recording medium P.

By doing this way, assuming that the pressing forces A and B of their respective pressing rollers 2A and 2B are the same, the virtual feed diameter of the conveyance roller 1B having a larger number of protrusions per unit area located at the downstream side in the conveyance direction becomes larger, and the conveyance length of a recording medium P by it becomes larger than that by the conveyance roller 1A. Accordingly, although being driven at the same speed by one and the same driving source, the conveyance rollers 1A and 1B make it possible to stretch the recording medium P at a suitable degree between them, which makes it possible to maintain the smoothness of the recording surface.

In addition, also in this embodiment, concerning the above-mentioned effect to be exhibited, a pressing force varying means is not required particularly for each of the pressing rollers 2A and 2B; however, it is a matter of course to make it possible by providing a pressing force varying means for each of the pressing rollers 2A and 2B in the same way as the first embodiment, to get rid of a problem of a recording medium P having a slack or an excessive stretch caused by the slight difference in the conveyance length produced between the conveyance rollers 1A and 1B.

Figure 8:
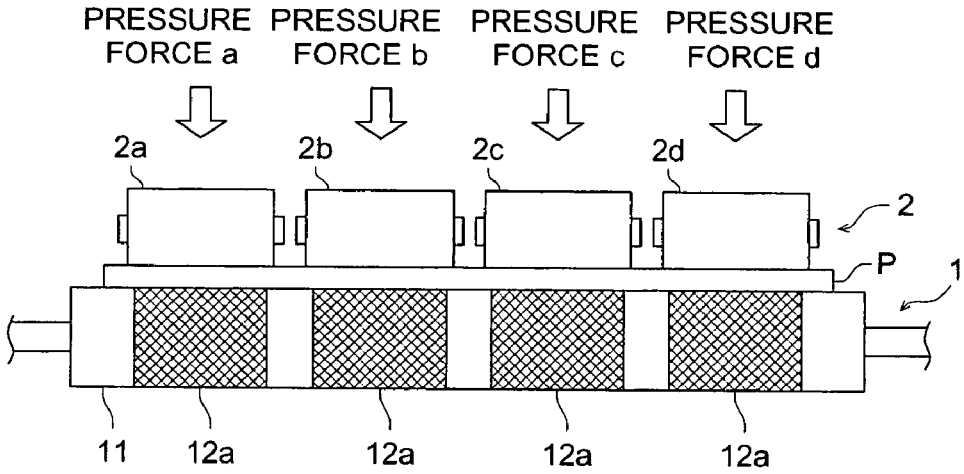
FIG. 8 is a drawing showing an outline of the structure of a recording medium conveyance device as further another example of the embodiment of this invention.

FIG. 8 shows the outline of the structure of a recording medium conveyance device as a further another example of the embodiment of this invention. In this drawing, its structure as viewed from the direction along the conveyance direction of a recording medium P is shown. The same signs as those in FIG. 1 and FIG. 2 indicate the same structure and their explanation will be omitted unless there is a particular difference.

In this case, a pressing roller 2 placed opposite to a conveyance roller 1 is divided into a plurality of portions along its axial direction (left-right direction in the drawing). Although it is shown in FIG. 8, an example in which the pressing roller is divided into four partial pressing rollers 2*a* to 2*d*, the number of divisions is not particularly limited, and is determined suitably in accordance with the size of the recording medium P to be conveyed.

Further, for each of the four divisional partial rollers 2*a* to 2*d*, a pressing force varying means for varying the pressing force acting on the recording medium P gripped between the conveyance roller 1 and the partial rollers is provided. As regards the pressing force varying means, any one may be employed so long as it can minutely vary the pressing force of each of the partial rollers 2*a* to 2*d* independently; for example, by being provided with their respective pressing force varying means 4 shown in FIG. 5 and FIG. 6, the partial rollers 2*a* to 2*d* press the recording medium P with their respective pressing forces a, b, c, and d between the common conveyance roller 1 and themselves.

This recording medium conveyance device is characterized by in that, by varying the pressing force of each of the partial pressing rollers 2*a* to 2*d* by each of the pressing force varying means provided for each of the partial rollers 2*a* to 2*d*, the penetration amount into a recording medium P of the protrusions of the conveyance roller 1 by each of the partial pressing rollers 2*a* to 2*d* is varied, which makes the conveyance length of the recording medium P vary in the axial direction of the conveyance roller 1.

By a recording medium conveyance device as explained above, even though a conveyance skew or a slack of a recording medium P is generated owing to it that the conveyance length varies in the axial direction of the conveyance roller 1 by the presence of a variation of the roller diameter in its axial direction, etc., by making the pressing force vary in the axial direction of the conveyance roller 1 through an independent adjustment of the pressing forces a to d of their respective partial rollers 2*a* to 2*d*, and by varying the penetration amount into the recording medium P of the protrusions formed in each of the portions, it is possible to make the conveyance length of the recording medium uniform along the whole axial length of the conveyance roller 1, which makes it possible to get rid of the problem of a conveyance skew and a slack.

For example, in a case where a conveyance skew of a recording medium is generated owing to the conveyance length of a recording medium P being smaller at the position of the partial pressing roller 2*a* than other positions of the partial pressing rollers, by making the pressing force a of the partial pressing roller 2*a* smaller than the pressing forces b to d of their respective partial pressing rollers 2*b* to 2*d*, it is possible to make the penetration amount into the recording medium P of the protrusions of said portions smaller. By this, the virtual feed diameter of the conveyance roller at the position of the partial pressing roller 2*a* is made larger and the conveyance length is adjusted to become larger, which makes it possible to make the conveyance length of a recording medium uniform along the whole axial length of the conveyance roller 1.

Further, on the contrary to this, it is also appropriate, by making the pressing forces b to d of their respective partial pressing rollers 2*b* to 2*d* larger than the pressing force a of the partial pressing roller 2*a*, to make larger the penetration amount into the recording medium P of the protrusions at the portions concerned. By this, the virtual feed diameter of the conveyance roller 1 at the positions of the partial pressing rollers 2*b* to 2*d* is made smaller, and the conveyance length in each portion is adjusted to become smaller, which makes it possible to make the conveyance length of the recording medium P uniform along the whole axial length of the conveyance roller 1.

By a recording medium conveyance device as described above, because it is possible to finely adjust the conveyance length of a recording medium P in the axial direction of the conveyance roller 1, it is particularly effective for a printer for recording an image on a recording medium P having a wide width, so-called a Large Format Printer.

Further, a recording medium conveyance device like this can be applied widely to apparatus each equipped with a conveyance system having a structure such that a recording medium is conveyed as gripped between a conveyance roller and a pressing roller.

Further, the recording medium conveyance device shown in FIG. 8 is not limited to one that conveys a recording medium by itself, but as shown in FIG. 7, when being installed in an ink jet recording apparatus, the device may be made up of two sets of a conveyance roller and a pressing roller with a recording means placed in between. In this case, if each of the sets of a conveyance roller and a pressing roller one of which is located at the upstream side in the conveyance direction and the other of which is located at the downstream side in the conveyance direction is made up in the same way as FIG. 8, it becomes possible to make the conveyance length of a recording medium P uniform along the whole axial length of the conveyance roller.

Any one of the recording medium conveyance devices explained up to now can be applied to all of the recording apparatus of an ink jet method having a structure such that a recording medium is conveyed by being gripped between a conveyance roller and a pressing roller. For such a recording apparatus, in addition to an ink jet printer, a copying machine or a fax machine of an ink jet method can be cited.

By this invention, it is possible to provide a recording medium conveyance device which can vary the virtual feed diameter of its conveyance roller by varying the penetration amount of the protrusions formed on the surface of the conveyance roller into a recording medium, and can minutely adjust the conveyance length of a recording medium, and an ink jet recording apparatus equipped therewith.

Further, by this invention, it is possible to provide a recording medium conveyance device which is capable of getting rid of the problem of a recording medium having a slack or an excessive stretch caused by a difference between two conveyance rollers in the conveyance length of a recording medium conveyed by the two conveyance rollers, and maintaining a high-quality image recording, and an ink jet recording apparatus equipped therewith.

Further, by this invention, it is possible to provide a recording medium conveyance device that is capable of preventing the generation of a conveyance skew or a slack of a recording medium caused by a variation of the conveyance length in the axial direction of the conveyance roller, and an ink jet recording apparatus equipped therewith.

What is claimed is:

1. A recording medium conveyance device comprising:

a first conveyance roller which is driven by a driving device and which includes a plurality of protrusions on a surface of the first conveyance roller;

first pressing roller which faces the first conveyance roller and which interposes and conveys a recording medium between the first pressing roller and the first conveyance roller; and a pressing force varying device which varies a pressing force of the first pressing roller that is applied to the recording medium;

wherein the pressing force varying device varies the pressing force of the first pressing roller applied to the recording medium so as to vary a penetration amount of the plurality of protrusions of the first conveyance roller into the recording medium and to thereby change an amount of conveyance of the recording medium;

wherein the recording medium conveyance device further comprises a second conveyance roller which is driven by the driving device and a second pressing roller which faces the second conveyance roller, and wherein the second conveyance roller and the second pressing roller are arranged downstream along a conveyance direction of the recording medium from the first conveyance roller and the first pressing roller with a recording head provided therebetween;

wherein the pressing force of the first pressing roller is greater than a pressing force of the second pressing roller, so as to cause a virtual feed diameter of the first conveyance roller to be less than a virtual feed diameter of the second conveyance roller; and wherein the pressing force of the first pressing roller and the pressing force of the second pressing roller are independently variable.

2. The recording medium conveyance device of claim 1, wherein the pressing force varying device varies the pressing force of the first pressing roller to satisfy an expression of $0.1\ t < H < 0.25\ t$, where t represents a thickness of the recording medium and H represents the penetration amount of the plurality of protrusions of the first conveyance roller into the recording medium.

3. An ink jet recording apparatus comprising the recording medium conveyance device of claim 1, wherein the recording head records an image on the recording medium by jetting ink drops toward the recording medium.

4. A recording medium conveyance device comprising:

a first conveyance roller which is driven by a driving device, and which includes a plurality of protrusions on a surface of the first conveyance roller; a first pressing roller which faces the first conveyance roller, and which interposes and conveys a recording medium between the first pressing roller and the first conveyance roller;

a second conveyance roller which is driven by the driving device, and which includes a plurality of protrusions on a surface of the second conveyance roller;

a second pressing roller which faces the second conveyance roller, and which interposes and conveys the recording medium between the second pressing roller and the second conveyance roller;

wherein the second conveyance roller and the second pressing roller are arranged downstream along a conveyance direction of the recording medium from the first conveyance roller and the first pressing roller with a recording head provided therebetween;

wherein a protruded height of each of the plurality of protrusions on the surface of the second conveyance roller is greater than a protruded height of each of the plurality of protrusions of the first conveyance roller; and wherein a virtual feed diameter of the first conveyance roller is less than a virtual feed diameter of the second conveyance roller.

5. An ink jet recording apparatus comprising the recording medium conveyance device of claim 4, wherein the recording head records an image on the recording medium by jetting ink drops toward the recording medium.

6. A recording medium conveyance device comprising:

a first conveyance roller which is driven by a driving device, and which includes a plurality of protrusions on a surface of the first conveyance roller;

a first pressing roller which faces the first conveyance roller, and which interposes and conveys a recording medium between the first pressing roller and the first conveyance roller;

a second conveyance roller which is driven by the driving device, and which includes a plurality of protrusions on a surface of the second conveyance roller;

a second pressing roller which faces the second conveyance roller, and which interposes and conveys the recording medium between the second pressing roller and the second conveyance roller;

wherein the second conveyance roller and the second pressing roller are arranged downstream along a conveyance direction of the recording medium from the first conveyance roller and the first pressing roller with a recording head provided therebetween;

wherein a density of protrusions on the surface of the second conveyance roller is greater than a density of protrusions on the surface of the first conveyance roller; and wherein a virtual feed diameter of the first conveyance roller is less than a virtual feed diameter of the second conveyance roller.

7. An ink jet recording apparatus comprising the recording medium conveyance device of claim 6, wherein the recording head records an image on the recording medium by jetting ink drops toward the recording medium.

* * * * *